US010457884B2

(12) United States Patent
Russo et al.

(10) Patent No.: US 10,457,884 B2
(45) Date of Patent: Oct. 29, 2019

(54) MIXED DETERGENT COMPOSITION FOR INTAKE VALVE DEPOSIT CONTROL

(71) Applicants: Joseph M. Russo, Katy, TX (US); William Jay Colucci, Glen Allen, VA (US)

(72) Inventors: Joseph M. Russo, Katy, TX (US); William Jay Colucci, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 15/035,372

(22) PCT Filed: Nov. 6, 2014

(86) PCT No.: PCT/US2014/064319
§ 371 (c)(1),
(2) Date: May 9, 2016

(87) PCT Pub. No.: WO2015/073296
PCT Pub. Date: May 21, 2015

(65) Prior Publication Data

US 2016/0289584 A1 Oct. 6, 2016

Related U.S. Application Data

(60) Provisional application No. 61/905,449, filed on Nov. 18, 2013.

(51) Int. Cl.

| | |
|---|---|
| ***C10L 1/22*** | (2006.01) |
| ***C10L 10/04*** | (2006.01) |
| ***C10L 1/224*** | (2006.01) |
| ***C10L 1/2383*** | (2006.01) |
| ***C10L 1/18*** | (2006.01) |
| ***C10L 10/08*** | (2006.01) |
| *C10L 1/198* | (2006.01) |
| *C10L 1/238* | (2006.01) |
| *C10L 1/185* | (2006.01) |
| *C10L 1/232* | (2006.01) |

(52) U.S. Cl.
CPC ..... *C10L 10/04* (2013.01); *C10L 1/18* (2013.01); *C10L 1/22* (2013.01); *C10L 1/224* (2013.01); *C10L 1/2383* (2013.01); *C10L 10/08* (2013.01); *C10L 1/1852* (2013.01); *C10L 1/1985* (2013.01); *C10L 1/221* (2013.01); *C10L 1/232* (2013.01); *C10L 1/238* (2013.01); *C10L 2200/0423* (2013.01); *C10L 2270/023* (2013.01); *C10L 2300/20* (2013.01); *C10L 2300/30* (2013.01)

(58) Field of Classification Search
None
See application file for complete search history.

(56) References Cited

U.S. PATENT DOCUMENTS

| | | | | |
|---|---|---|---|---|
| 2,425,755 | A | 8/1947 | Roberts et al. | |
| 2,425,845 | A | 8/1947 | Toussaint et al. | |
| 2,448,664 | A | 9/1948 | Fife et al. | |
| 2,457,139 | A | 12/1948 | Fife et al. | |
| 2,475,755 | A | 7/1949 | Pearson | |
| 3,172,892 | A | 3/1965 | Le Suer et al. | |
| 3,202,678 | A | 8/1965 | Stuart et al. | |
| 3,216,936 | A | 11/1965 | Le Suer | |
| 3,219,666 | A | 11/1965 | Norman et al. | |
| 3,254,025 | A | 5/1966 | Le Suer | |
| 3,272,746 | A | 9/1966 | Le Suer et al. | |
| 3,361,673 | A | 1/1968 | Stuart et al. | |
| 3,676,089 | A | 7/1972 | Morris | |
| 4,038,043 | A * | 7/1977 | Garth | C10L 1/2383 44/425 |
| 4,152,499 | A | 5/1979 | Boerzel et al. | |
| 4,231,759 | A | 11/1980 | Udelhofen et al. | |
| 4,234,435 | A | 11/1980 | Meinhardt et al. | |
| 4,605,808 | A | 8/1986 | Samson | |
| 4,613,341 | A | 9/1986 | Zaweski et al. | |
| 4,729,769 | A | 3/1988 | Schlicht et al. | |
| 4,844,714 | A | 7/1989 | Vogel et al. | |
| 4,877,416 | A | 10/1989 | Campbell | |
| 5,393,309 | A | 2/1995 | Cherpeck | |
| 5,514,190 | A | 5/1996 | Cunningham et al. | |

(Continued)

FOREIGN PATENT DOCUMENTS

| | | | | |
|---|---|---|---|---|
| CA | 2089833 | A1 | 8/1993 | |
| CN | 1256302 | A | 6/2000 | |
| EP | 0016312 | A1 | 10/1980 | |
| EP | 1293553 | A2 * | 3/2003 | C10L 1/143 |
| EP | 1411105 | | 4/2004 | |
| EP | 1918355 | | 5/2008 | |
| GB | 2493377 | A1 | 2/2013 | |
| WO | 2004050806 | | 6/2004 | |
| WO | 2005023965 | A1 | 3/2005 | |

OTHER PUBLICATIONS

Extended European Search Report for corresponding EP Application No. 14862960.3 dated Nov. 30, 2016.
International Search Report and Written Opinion for corresponding WO Application No. PCT/US2014/064319 dated Feb. 17, 2015.
International Search Report and Written Opinion for corresponding WO Application No. PCT/US2018/022098 dated May 31, 2018.

*Primary Examiner* — Ellen M McAvoy
*Assistant Examiner* — Ming Cheung Po
(74) *Attorney, Agent, or Firm* — Honigman LLP

(57) ABSTRACT

A detergent additive package, fuel additive concentrate, fuel composition and method for operating an engine on an unleaded gasoline fuel. The additive package includes a Mannich base detergent mixture, wherein the mixture contains a first Mannich base detergent component derived from a di- or polyamine and a second Mannich base detergent component derived from a monoamine. A weight ratio of the first Mannich base detergent to the second Mannich base detergent in the mixture ranges from about 1:6 to about 3:1.

22 Claims, No Drawings

(56) References Cited

U.S. PATENT DOCUMENTS

| | | | |
|---|---|---|---|
| 5,518,511 | A | 5/1996 | Russell et al. |
| 5,575,823 | A | 11/1996 | Wallace et al. |
| 5,620,486 | A | 4/1997 | Cherpeck |
| 5,634,951 | A | 6/1997 | Colucci et al. |
| 5,697,988 | A | 12/1997 | Malfer et al. |
| 5,725,612 | A | 3/1998 | Malfer et al. |
| 5,814,111 | A | 9/1998 | Graham et al. |
| 5,873,917 | A | 2/1999 | Daly |
| 5,876,468 | A | 3/1999 | Moreton |
| 6,048,373 | A | 4/2000 | Malfer et al. |
| 6,166,238 | A | 12/2000 | Filipkowski et al. |
| 6,458,172 | B1 | 10/2002 | Macduff et al. |
| 6,475,250 | B2 | 11/2002 | Krull et al. |
| 6,548,458 | B2 | 4/2003 | Loper |
| 6,695,890 | B1 | 2/2004 | Hazel et al. |
| 6,730,773 | B2 | 5/2004 | Heinen |
| 6,800,103 | B2 | 10/2004 | Malfer et al. |
| 6,867,171 | B2 | 3/2005 | Harrison et al. |
| 7,402,185 | B2 | 7/2008 | Aradi et al. |
| 7,435,272 | B2 | 10/2008 | Aradi et al. |
| 7,704,289 | B2 | 4/2010 | Arters et al. |
| 7,766,982 | B2 | 8/2010 | Colucci et al. |
| 8,097,570 | B2 | 1/2012 | Boitout et al. |
| 8,231,695 | B2 | 7/2012 | Cunningham et al. |
| 8,425,627 | B2 | 4/2013 | Dietz et al. |
| 8,449,630 | B2 * | 5/2013 | Lange ..... C08F 8/32 44/412 |
| 8,486,876 | B2 | 7/2013 | Brewer et al. |
| 8,496,716 | B2 | 7/2013 | Lange et al. |
| 8,557,003 | B2 | 10/2013 | Malfer et al. |
| 8,778,034 | B2 | 7/2014 | Cunningham |
| 2004/0060226 | A1 | 4/2004 | Bongart et al. |
| 2005/0066572 | A1 | 3/2005 | Colucci et al. |
| 2005/0215411 | A1 | 9/2005 | Mackney et al. |
| 2006/0070293 | A1 | 4/2006 | Lange et al. |
| 2006/0168876 | A1 | 8/2006 | Colucci et al. |
| 2006/0196110 | A1 | 9/2006 | Schwahn et al. |
| 2006/0196111 | A1 | 9/2006 | Colucci et al. |
| 2007/0245621 | A1 | 10/2007 | Malfer et al. |
| 2008/0086936 | A1 * | 4/2008 | Cunningham ..... C10L 1/023 44/457 |
| 2009/0049740 | A1 | 2/2009 | Hurst |
| 2009/0235576 | A1 | 9/2009 | Volkel et al. |
| 2010/0005706 | A1 | 1/2010 | Burgazli et al. |
| 2010/0132253 | A1 | 6/2010 | Kaufman et al. |
| 2011/0162263 | A1 | 7/2011 | Vilardo et al. |
| 2013/0237466 | A1 * | 9/2013 | Lange ..... C08F 8/32 508/561 |
| 2013/0247450 | A1 | 9/2013 | Wolf |
| 2013/0255139 | A1 | 10/2013 | Dolmazon et al. |
| 2013/0312318 | A1 | 11/2013 | Peretolchin et al. |
| 2013/0227878 | A1 | 12/2013 | Wolf et al. |
| 2013/0324665 | A1 | 12/2013 | Shaikh et al. |
| 2016/0272912 | A1 | 9/2016 | Voelkel et al. |

* cited by examiner

MIXED DETERGENT COMPOSITION FOR INTAKE VALVE DEPOSIT CONTROL

TECHNICAL FIELD

The present invention relates to spark-ignition fuel compositions, fuel additive compositions, and methods for controlling, i.e. reducing or eliminating, injector deposits in spark-ignition internal combustion engines, and improving antiwear performance. More particularly, the invention relates to fuel compositions comprising a spark-ignition fuel and a mixed detergent additive composition for the fuel, and the use of said fuel compositions in direct injection gasoline (DIG) engines.

BACKGROUND AND SUMMARY

Over the years considerable work has been devoted to additives for controlling (preventing or reducing) deposit formation in the fuel induction systems of spark-ignition internal combustion engines. In particular, additives that can effectively control fuel injector deposits, intake valve deposits and combustion chamber deposits represent the focal point of considerable research activities in the field and despite these efforts, further improvements are desired particularly in view of further advances in engine technology for improved fuel economy and engine wear.

DIG technology is currently on a steep developmental curve because of its high potential for improved fuel economy and power. Environmentally, fuel economy benefits of such engines translate directly into lower carbon dioxide emissions. However, DIG engines may encounter problems different from those of the conventional gasoline engines due to the direct injection of gasoline into the combustion chamber.

One of the major obstacles in DIG engine development was spark plug fouling. A narrow spacing configuration, where the fuel injector sat close to the spark plug, allowed easy fuel ignition as the fuel directly hit the plug. However, such close spacing causes soot to accumulate on the plug, eventually leading to spark plug fouling.

Another problem with DIG engines is related to the smoke exhausted mainly from the part of the mixture in which the gasoline is excessively rich, upon stratified combustion of the filet. The amount of soot produced is greater than that of a conventional engine, thus a greater amount of soot may enter the lubricating oil through combustion gas blow by.

As different, more advanced engine types enter service worldwide, a fuel to power not only traditional multi-port fuel injected engines, but also gasoline direct injection engines may be required. The additives which work well as detergents in MPI engines will not necessarily work well in GDI engines, and as such additional detergents prepared especially for DIG engines may be required as a "top-treat" type additive or as an after-market fuel supplement.

In addition to the above, the present generation of DIG engine technologies have experienced deposit problems. Areas of particular concern are fuel rails, injectors, combustion chamber (CCD), crankcase soot loadings, and intake valves (IVD). Deposits in the intake manifold come in through the PCV valve and exhaust gas recirculation (FUR). Since there is no liquid filet wetting the back of the intake valves, these deposits build up quite quickly and can cause reduction in fuel economy over time if they are not removed.

Yet another problem with newer gasoline engine is increased wear of fuel contacted components of the engine.

In particular, increasing amounts of oxygenates in the gasoline compositions from about 0 to about 85 percent by volume tend to increase wear of fuel contacted components in the engine.

In view of the foregoing, various embodiments of the disclosure provide fuel compositions for a spark-ignition internal engine, a fuel additive package for a spark-ignition engine, a method of operating a spark-ignition engine, and a method of reducing intake valve deposits or improving antiwear performance in a spark-ignition engine. The additive package includes a Mannich base detergent mixture that comprised of a first Mannich base detergent component derived from a di- or polyamine and a second Mannich base detergent component derived from a monoamine. A weight ratio of the first Mannich base detergent to the second Mannich base detergent in the mixture ranges from about 1:6 to about 3:1, such as from 1:4 to 2:1 or from 1:3 to 1:1.

In one embodiment of the disclosure, a fuel additive package is provided for a spark-ignition engine that includes, a) a first Mannich base detergent component derived from a di- or polyamine, (b) a second Mannich base detergent component derived from a monoamine, (c) an antiwear component, and (d) optionally, a carrier fluid component selected from the group consisting of a polyether monool and polyether polyol. A weight ratio of the first Mannich base detergent to the second Mannich base detergent in the fuel additive package ranges from about 1:6 to about 3:1, such as from 1:4 to 2:1 or from 1:3 to 1:1.

In another embodiment of the disclosure, a method for operating a spark-ignition engine on an unleaded fuel composition is provided. The method includes supplying to the engine a fuel composition that includes (a) a gasoline fuel, (b) a first Mannich base detergent derived from a di- or polyamine, (c) a second Mannich base detergent derived from a monoamine, (d) an antiwear component, and (e) optionally, a succinimide detergent. A weight ratio of (b) to (c) in the fuel ranges from about 1:6 to about 3:1, such as from 1:4 to 2:1 or from 1:3 to 1:1. The fuel composition is introduced into the engine for combustion thereof, and the engine is operated on the fuel.

Yet another embodiment of the disclosure, there is provided an unleaded fuel composition for a spark-ignited engine. The fuel composition includes (a) a major amount of a gasoline fuel, (b) a minor amount of a first Mannich base detergent derived from a di- or polyamine, (c) minor amount of a second Mannich base detergent derived from an di-alkyl monoamine, (d) an antiwear component selected from the group consisting of a hydrocarbyl amide and a hydrocarbyl imide, and (I) a polyether carrier fluid. A weight ratio of the first Mannich base detergent to the second Mannich base detergent in the fuel composition ranges from 1:6 to about 3:1, such as from 1:4 to 2:1 or from 1:3 to 1:1.

Another embodiment of the disclosure a method for improving at least one of reducing intake valve deposits or improving antiwear performance in a spark-ignition engine. The method includes providing a fuel composition that includes (a) a major amount of a gasoline fuel containing ethanol, (b) a minor amount of a first Mannich base detergent derived from a di- or polyamine, (c) minor amount of a second Mannich base detergent derived from an di-alkyl monoamine, (d) an antiwear component selected from the group consisting of a hydrocarbyl amide and a hydrocarbyl imide, and (e) a polyether carrier fluid comprising C6-C20 alkylphenol propoxylate. A weight ratio of the first Mannich base detergent to the second Mannich base detergent in the fuel composition ranges from 1:6 to about 3:1 such as from 1:4 to 2:1 or from 1:3 to 1:1. The fuel composition is supplied to the engine and combusted in the engine.

Accordingly, the Mannich base detergent of embodiments of the disclosure includes at least two different Mannich base detergents as described in more detail below. Advantages of the disclosed embodiments, may include, but are not limited to, one or more of improved injector performance, reduced engine deposits, improved antiwear performance of moving parts in the engine, improved fuel economy, reduced intake valve deposits, reduced injector deposits and/or reduced soot formation in spark-ignition engines, especially DIG engines, and reduced fuel plugging. Further benefits and advantages may be evidence from the following detailed description of the disclosed embodiments.

It will be appreciated that the terminology "deposit inhibitor compound" can be a compound, the presence of which in the fuel composition, directly or indirectly results in controlled, i.e., reduced or eliminated, deposits and/or soot formation in the engine.

DETAILED DESCRIPTION OF EXEMPLARY EMBODIMENTS

Mannich Base Detergents

The Mannich base detergents useful in embodiments of the disclosure are the reaction products of an alkyl-substituted hydroxy aromatic compound, an aldehyde and an amine. The alkyl-substituted hydroxyaromatic compound, aldehyde and amine used in making the Mannich detergent reaction products described herein may be any such compounds known and applied in the art, provided the Mannich based detergents include at least a first Mannich base detergent derived from a di- or polyamine and at least a second Mannich base detergent derived from a dialkyl monoamine.

Representative alkyl-substituted hydroxyaromatic compounds that may be used in forming the Mannich base reaction products are polypropylphenol (formed by alkylating a phenol with polypropylene), polybutylphenols (formed by alkylating a phenol with polybutenes and/or polyisobutylene), and polybutyl-co-polypropylphenol (formed by alkylating phenol with a copolymer of butylene and/or butylene and propylene). Other similar long-chain alkylphenols may also be used. Examples include phenols alkylated with copolymers of butylene and/or isobutylene and/or propylene, and one or more mono-olefinic co-monomers copolymerizable therewith (e.g., ethylene, 1-pentene, 1-hexene, 1-octene, 1-decene, etc.) where the copolymer molecule contains at least 50% by weight, of butylene and/or isobutylene and/or propylene units. The comonomers polymerized with propylene, butylenes and/or isobutylene may be aliphatic and may also contain non-aliphatic groups, e.g., styrene, o-methylstyrene, p-methylstyrene, di-vinyl benzene and the like. Thus in any case the resulting polymers and copolymers used in forming the alkyl-substituted hydroxyaromatic compounds are substantially aliphatic hydrocarbon polymers.

In one embodiment herein, polybutylphenol (formed by alkylating a phenol with polybutylene) is used in forming the Mannich base detergents. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polybutylenes having relatively high proportions of polymer molecules having a terminal vinylidene group, formed by methods such as described, for example, in U.S. Pat. No. 4,152,499 and W. German Offenlegungsschrift 29 04 314, are also suitable for use in forming the long chain alkylated phenol reactant.

The alkylation of the hydroxyaromatic compound is typically performed in the presence of an alkylating catalyst at a temperature in the range of about 50° to about 200° C. Acidic catalysts are generally used to promote Friedel-Crafts alkylation. Typical catalysts used in commercial production include sulfuric acid, $BF_3$, aluminum phenoxide, methanesulphonic acid, cationic exchange resin, acidic clays and modified zeolites.

The long chain alkyl substituents on the benzene ring of the phenolic compound are derived from polyolefin having a number average molecular weight (MW of from about 500 to about 3000 Daltons (preferably from about 500 to about 2100 Daltons) as determined by gel permeation chromatography (GPC). It is also desirable that the polyolefin used have a polydispersity (weight average molecular weight/number average molecular weight) in the range of about 1 to about 4 (suitably from about 1 to about 2) as determined by GPC.

The chromatographic conditions for the GPC method referred to throughout the specification are as follows: 20 micro L of sample having a concentration of approximately 5 mg/mL (polymer/unstabilized tetrahydrofuran solvent) is injected into 1000 A, 500 A and 100 A columns at a flow rate of 1.0 mL/min. The run time is 40 minutes. A Differential Refractive Index detector is used and calibration is made relative to polyisobutene standards having a molecular weight range of 284 to 4080 Daltons.

The Mannich detergents may be made from a long chain alkylphenol. However, other phenolic compounds may be used including high molecular weight alkyl-substituted derivatives of resorcinol, hydroquinone, catechol, hydroxydiphenyl, benzylphenol, phenethylphenol, naphthol, tolylnaphthol, among others. Particularly suitable for the preparation of the Mannich condensation products are the polyalkylphenol and polyalkylcresol reactants, e.g., polypropylphenol, polybutylphenol, polypropylcresol, polyisobutylcresol, and polybutylcresol, wherein the alkyl group has a number average molecular weight of about 500 to about 2100, while the most suitable alkyl group is a polybutyl group derived from polybutylene having a number average molecular weight in the range of about 800 to about 1300 Daltons.

The configuration of the alkyl-substituted hydroxyaromatic compound is that of a para-substituted mono-alkylphenol or a para-substituted mono-alkyl ortho-cresol. However, any alkylphenol readily reactive in the Mannich condensation reaction may be used. Thus, Mannich products made from alkylphenols having only one ring alkyl substituent, or two or more ring alkyl substituents are suitable for use in making the Mannich base detergents described herein. The long chain alkyl substituents may contain some residual unsaturation, but in general, are substantially saturated alkyl groups. Long chain alkyl phenols, according to the disclosure, include cresol.

Representative amine reactants include, but are not limited to, linear, branched or cyclic alkylene monoamines and di- or polyamines having at least one suitably reactive primary or secondary amino group in the molecule. Other substituents such as hydroxyl, cyano, amido, etc., may be present in the amine compound. In one embodiment, the first Mannich base detergent is derived from an alkylene di- or polyamine. Such di- or polyamines may include, but are not limited to, polyethylene polyamines, such as ethylenediamine, diethylenetriamine, triethylenetetramine, tetraethylenepentamine, pentaethylenehexamine, hexaethyleneheptamine, heptaethyleneoctamine, octaethylenenonamine, nonaethylenedecamine, decaethyleneundecamine and mixtures of such amities having nitrogen contents corresponding to alkylene polyamines of the formula $H_2N$-(A-NH—)$_n$H, where A is divalent ethylene and n is an integer of from 1 to 10. The alkylene polyamines may be obtained by the reaction of ammonia and dihaloalkanes, such as dichloro alkanes. Thus, the alkylene polyamines obtained from the reaction of 2 to 11 moles of ammonia with 1 to 10 moles of dichloro alkanes having 2 to 6 carbon atoms and the chlorines on different carbon atoms are suitable alkylene polyamine reactants.

In one embodiment, the first Mannich base detergent is derived from an aliphatic linear, branched or cyclic diamine or polyamine having one primary or secondary amino group and one tertiary amino group in the molecule. Examples of suitable polyamines include N,N,N",N"-tetraalkyl-dialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylene-tetramines (one terminal tertiary amino group, two internal tertiary amino groups and one terminal secondary amino group), N,N-dihydroxyalkyl-alpha, omega-alkylenediamines (one terminal tertiary amino group and one terminal primary amino group), N,N,N'-trihydroxy-alkyl-alpha, omega-alkylenediamines (one terminal tertiary amino group and one terminal secondary amino group), tris(dialkylaminoalkyl)aminoalkylmethanes (three terminal tertiary amino groups and one terminal primary amino group), and like compounds, wherein the alkyl groups are the same or different and typically contain no more than about 12 carbon atoms each, and which suitably contain from 1 to 4 carbon atoms each. In one embodiment, the alkyl groups of the polyamine are methyl and/or ethyl groups. Accordingly, the polyamine reactants may be selected from N,N-dialkyl-alpha, omega-alkylenediamine, such as those having from 3 to about 6 carbon atoms in the alkylene group and from 1 to about 12 carbon atoms in each of the alkyl groups. A particularly useful polyamine is N,N-dimethyl-1,3-propanediamine and N-methyl piperazine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propanediamine, N-(tert-butyl)-1-methyl-1,2-ethanediamine, N-(tert-butyl)-1-methyl-1,3-propanediamine, and 3,5-di (tert-butyl)aminoethy-1-piperazine.

The second Mannich base detergent may be derived from an alkyl-monoamine, that includes, without limitation, a di-alkyl monoamine, such as methylamine, dimethyl amine, ethylamine, di-ethylamine, propylamine, isopropylamine, dipropyl amine, di-isopropyl amine, butylamine, isobutylamine, di-butyl amine, di-isobutylamine, pentylamine, dipentyl amine, neopenylamine, di-neopentyl amine, hexylamine dihexyl amine, heptylamine diheptyl amine, octylamine, dioctyl amine, 2-ethylhexylamine, di-2-ethylhexyl amine, nonylamine, dinonyl amine, decylamine, didecyl amine, dicyclohexylamine, and the like.

Representative aldehydes for use in the preparation of the Mannich base products include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. A particularly suitable aldehyde may be selected from formaldehyde and formalin.

The condensation reaction among the alkylphenol, the specified amine(s) and the aldehyde may be conducted at a temperature in the range of about 40° to about 200° C. The reaction may be conducted in bulk (no diluent or solvent) or in a solvent or diluent. Water is evolved and may be removed by azeotropic distillation during the course of the reaction. Typically, the Mannich reaction products are formed by reacting the alkyl-substituted hydroxyaromatic compound, the amine and aldehyde in the molar ratio of 1.0:0.5-2.0:1.0-3.0, respectively.

Suitable Mannich base detergents for use in the disclosed embodiments include those detergents taught in U.S. Pat. Nos. 4,231,759; 5,514,190; 5,634,951; 5,697,988; 5,725,612; 5,876,468; and 6,800,103, the disclosures of which are incorporated herein by reference.

When formulating the fuel compositions of the disclosure, a mixture of the Mannich base detergents is used. The mixture of Mannich base detergents includes a weight ratio of from about 1:6 to about 3:1 of the first Mannich base detergent to the second Mannich base detergent. In another embodiment, the mixture of Mannich base detergents includes a weight ratio of from about 1:4 to about 2:1, such as from about 1:3 to about 1:1 of the first Mannich base detergent to the second Mannich base detergent. The total amount of Mannich base detergent in a gasoline fuel composition according to the disclosure may range from about 10 to about 400 parts per million by weight based on a total weight of the fuel composition.

Succinimide Base Detergent

An optional component of the fuel compositions described herein is a succinimide detergent. The succinimide detergent suitable for use in various embodiments of the disclosure may impart a dispersant effect on the fuel composition when added in an amount effective for that purpose. The presence of the succinimide, together with the mixed Mannich base detergents, in the fuel composition is observed to result in enhanced deposit formation control, relative to the performance of the succinimide together with either the first or second Mannich base detergent.

The succinimide detergents, for example, include alkenyl succinimides comprising the reaction products obtained by reacting an alkenyl succinic anhydride, acid, acid-ester or lower alkyl ester with an amine containing at least one primary amine group. Representative non-limiting examples are given in U.S. Pat. Nos. 3,172,892; 3,202,678; 3,219,666; 3,272,746, 3,254,025, 3,216,936, 4,234,435; and 5,575,823. The alkenyl succinic anhydride may be prepared readily by heating a mixture of olefin and maleic anhydride to about 180-220° C. The olefin is, in an embodiment, a polymer or copolymer of a lower monoolefin such as ethylene, propylene, isobutene and the like. In another embodiment the source of alkenyl group is from polyisobutene having a molecular weight up to 10,000 Daltons or higher. In another embodiment the alkenyl is a polyisobutene group having a molecular weight of about 500-5,000 Daltons and typically about 700-2,000 Daltons. In a preferred embodiment, the succinimide is derived from tetraethylene pentamine (TEPA) and polyisobutylene succinic anhydride (PIBSA) in a 1:1 molar ratio, wherein the RIB is about 950 molecular weight.

Amines which may be used to make the succinimide detergents include any that have at least one primary amine group which can react to form an imide group. A few representative examples are: methylamine, 2-ethylhexylamine, n-dodecylamine, stearylamine, N,N-dimethyl-propanediamine, N-(3-aminopropyl)morpholine, N-dodecyl propanediamine, N-aminopropyl piperazine ethanolamine, N-ethanol ethylene diamine and the like. Particularly suitable amines include the alkylene polyamines such as propylene diamine, dipropylene triamine, di-(1,2-butylene)-triamine, tetra-(1,2-propylene)pentamine and TEPA.

In one embodiment the amines are the ethylene polyamines that have the formula $H_2N(CH_2CH_2NH)_nH$ wherein n is an integer from one to ten. These ethylene polyamines include ethylene diamine, diethylene triamine, triethylene tetramine, tetraethylene pentamine, pentaethylene hexamine, and the like, including mixtures thereof in which case n is the average value of the mixture. These ethylene polyamines have a primary amine group at each end so can form mono-alkenylsuccinimides and bis-alkenylsuccinimides.

The succinimide detergents for use in the disclosed embodiments also include the products of reaction of a polyethylenepolyamine, e.g. triethylene tetramine or tetraethylene pentamine, with a hydrocarbon substituted carboxylic acid, diacid, or anhydride made by reaction of a polyolefin, such as polyisobutene, having a molecular weight of 500 to 5,000 Daltons, especially 700 to 2000 Daltons, with an unsaturated polycarboxylic acid, diacid, or anhydride, e.g. maleic anhydride.

Also suitable for use as the succinimide detergents of the disclosed embodiments are succinimide-amides prepared by reacting a succinimide-acid with a polyamine or partially alkoxylated polyamine, as taught in U.S. Pat. No. 6,548,458. The succinimide-acid compounds of the may be prepared by reacting an alpha-omega amino acid with an alkenyl or alkyl-substituted succinic anhydride in a suitable reaction media. Suitable reaction media include, but are not limited to, an organic solvent, such as toluene, or process oil. Water is a by-product of this reaction. The use of toluene allows for azeotropic removal of water.

The mole ratio of maleic anhydride to olefin in the reaction mixture used to make the succinimide detergents can vary widely. In one example, the mole ratio of maleic anhydride to olefin is from 5:1 to 1:5, and in another example the range is from 3:1 to 1:3 and in yet another embodiment the maleic anhydride is used in stoichiometric excess, e.g. 1.1 to 5 motes maleic anhydride per mole of olefin. The unreacted maleic anhydride can be vaporized from the resultant reaction mixture.

The alkyl or alkenyl-substituted succinic anhydrides may be prepared by the reaction of maleic anhydride with the desired polyolefin or chlorinated polyolefin, under reaction conditions well known in the art. For example, such succinic anhydrides may be prepared by the thermal reaction of a polyolefin and maleic anhydride, as described, for example in U.S. Pat. Nos. 3,361,673 and 3,676,089. Alternatively, the substituted succinic anhydrides may be prepared by the reaction of chlorinated polyolefins with maleic anhydride, as described, for example, in U.S. Pat. No. 3,172,892. A further discussion of hydrocarbyl-substituted succinic anhydrides can be found, for example, in U.S. Pat. Nos. 4,234,435; 5,620,486 and 5,393,309.

Polyalkenyl succinic anhydrides may be converted to polyalkyl succinic anhydrides by using conventional reducing conditions such as catalytic hydrogenation. For catalytic hydrogenation, a preferred catalyst is palladium on carbon. Likewise, polyalkenyl succinimides may be converted to polyalkyl succinimides using similar reducing conditions.

The polyalkyl or polyalkenyl substituent on the succinic anhydrides used to make the succinimide detergents may be derived from polyolefins which are polymers or copolymers of mono-olefins, particularly 1-mono-olefins, such as ethylene, propylene, butylene, and the like. When used, the mono-olefin will have 2 to about 24 carbon atoms, and typically, about 3 to 12 carbon atoms. Also, the mono-olefins may include propylene, butylene, particularly isobutylene, 1-octene and 1-decene. Polyolefins prepared from such mono-olefins include polypropylene, polybutene, polyisobutene, and the polyalphaolefins produced from 1-octene and 1-decene.

In one embodiment the polyalkyl or polyalkenyl substituent is one derived from polyisobutene. Suitable polyisobutenes for use in preparing the succinimide-acids of the present invention include those polyisobutenes that comprise at least about 20% of the more reactive methylvinylidene isomer, for example, at least 50% and desirably at least 70% reactive methylvinylidene isomer. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. The amount of succinimide detergent used in the fuel compositions described herein may have a weight ratio of succinimide detergent to Mannich base detergent mixture ranging from about 1:6 to about 1:12, for example, from about 1:9 to about 1:11 succinimide detergent to Mannich base detergent mixture.

Carrier Fluids

In another embodiment, the Mannich base detergent mixture and the succinimide detergent may be used with a liquid carrier or induction aid. Such carriers may be of various types, such as for example liquid poly-alpha-olefin oligomers, mineral oils, liquid poly(oxyalkylene) compounds, liquid alcohols or polyols, polyalkenes, liquid esters, and similar liquid carriers. Mixtures of two or more such carriers may be used.

The poly(oxyalkylene) carrier fluids may be made from alkylene oxides such as ethylene oxide, propylene oxide, and butylene oxide. The number of alkylene oxide units in the poly(oxyalkylene) compound may be from about 10 to about 35, and for example from about 20 to about 30.

The poly(oxyalkylene) compounds which are among the carrier fluids for use in disclosed embodiments are fuel-soluble compounds which may be represented by the following formula $R^1—(R^2—O)_n—R^3$ wherein $R^1$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, $R^2$ is an alkylene group having 2-10 carbon atoms (preferably 2-4 carbon atoms), $R^3$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, and n is an integer from 1 to 500 and desirably in the range of from 3 to 120, and typically in the range of from 15 to 35 representing the number (usually an average number) of repeating alkyleneoxy groups. In compounds having multiple $—R^2—O—$ groups, $R^2$ may be the same or different alkylene group and where different, can be arranged randomly or in blocks. Suitable poly(oxyalkylene) compounds are monools comprised of repeating units formed by reacting an alcohol with one or more alkylene oxides.

The average molecular weight of the poly(oxyalkylene) compounds that may be used as carrier fluids is typically in the range of from about 500 to about 3000 Daltons, suitably from about 750 to about 2500 Daltons, and desirably from above about 1000 to about 2000 Daltons.

One useful sub-group of poly(oxyalkylene) compounds that may be used includes the hydrocarbyl-terminated poly (oxyalkylene) monools such as are referred to in the passage at column 6, line 20 to column 7 line 14 of U.S. Pat. No. 4,877,416 and references cited in that passage, said passage and said references being fully incorporated herein by reference.

A useful sub-group of poly(oxyalkylene) compounds is made up of one or a mixture of alkylpoly(oxyalkylene) monools which in its undiluted state is a gasoline-soluble liquid having of at least about 60 cSt at 40° C. (for example, at least about 70 cSt at 40° C.) and at least about 11 cSt at 100° C. (for example, at least about 13 cSt at 100° C.). In addition, the poly(oxyalkylene) compounds have viscosities in their undiluted state of no more than about 400 cSt at 40° C. and no more than about 50 cSt at 100° C. For example, such poly(oxyalkylene) compounds will have viscosities that do not exceed about 300 cSt at 40° C. and about 40 cSt at 100° C.

The poly(oxyalkylene) compounds may also include poly (oxyalkylene) glycol compounds and mono ether derivatives thereof that satisfy the above viscosity requirements and that are comprised of repeating units formed by reacting an alcohol or polyalcohol with an alkylene oxide, such as propylene oxide and/or butylene oxide with or without use of ethylene oxide, and especially products in which at least 80 mole % of the oxyalkyiene groups in the molecule are derived from 1,2-propylene oxide. Details concerning preparation of such poly(oxyalkylene) compounds are referred to, for example, in Kirk-Othmer, Encyclopedia of Chemical Technology, Third Edition, Volume 18, pages 633-645 (Copyright 1982 by John Wiley & Sons), and in references cited therein, the foregoing excerpt of the Kirk-Othmer encyclopedia and the references cited therein being incorporated herein in toto by reference. U.S. Pat. Nos. 2,475,755; 2,425,845; 2,448,664; and 2,457,139 also describe such procedures, and are fully incorporated herein by reference.

The poly(oxyalkylene) compounds, when used, may contain a sufficient number of branched oxyalkylene units (e.g., methyldimethyleneoxy units and/or ethyldimethyleneoxy units) to render the poly(oxyalkylene) compound gasoline soluble.

Suitable poly(oxyalkylene) compounds for use in the disclosed embodiments include those taught in U.S. Pat. Nos. 5,514,190; 5,634,951; 5,697,988; 5,725,612; 5,814,111 and 5,873,917, the disclosures of which are incorporated herein by reference. In one embodiment, the poly(oxyalkylene) compound may be a polyether carrier fluid. In another embodiment the carrier fluid may be selected from a polyether monool or polyether polyol. In one embodiment, the polyether carrier fluid may be selected from a $C_6$-$C_{20}$ alkylphenol propoxylate and a $C_{10}$-$C_{24}$ alcohol propoxylate.

In some cases, the Mannich base detergents may be synthesized in the carrier fluid. In other instances, the preformed detergent mixture is blended with a suitable amount of the carrier fluid. If desired, the detergent may be formed in a suitable carrier fluid and then blended with an additional quantity of the same or a different carrier fluid. In one embodiment, the ratio of carrier fluid to Mannich base detergent mixture may be about 1:1 by weight. In another embodiment, the carrier fluid may be present in weight ratio of carrier fluid to Mannich base detergent mixture ranging from about 0.4:1 to about 1:1, for example from about 0.5:1 to about 0.9:1, or from about 0.6:1 to about 0.8:1.

Antiwear Additive

The anti-wear component for the fuel compositions, additives and methods described herein may be selected from a hydrocarbyl amide and a hydrocarbyl imide. In one embodiment, the hydrocarbyl amide is an alkanol amide derived from diethanol amine and oleic acid. In another embodiment, the hydrocarbyl imide is a succinimide derived from polyisobutenyl succinic anhydride and ammonia.

In one embodiment, the hydrocarbyl amide compound may be one or more fatty acid alkanol amide compounds.

The fatty acid alkanol amide is typically the reaction product of a $C_4$ to $C_{75}$, for example $C_6$ to $C_{30}$, and typically a $C_8$ to $C_{22}$, fatty acid or ester, and a mono- or di-hydroxy hydrocarbyl amine, wherein the fatty acid alkanol amide will typically have the following formula:

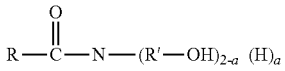

wherein R is a hydrocarbyl group having from about 4 to 75, for example, from about 6 to 30, desirably from about 8 to 22, carbon atoms; R' is a divalent alkylene group having from 1 to about 10, typically from 1 to about 6, or from about 2 to 5, and desirably from about 2 to 3, carbon atoms; and a is an integer from about 0 to 1.

The acid moiety may be RCO— wherein R is an alkyl or alkenyl hydrocarbon group containing from about 4 to 75, for example, from about 5 to 19 carbon atoms typified by caprylic, caproic, capric, lauric, myristic, palmitic, stearic, oleic, linoleic, etc. The acid may be saturated or unsaturated.

The acid moiety may be supplied in a fully esterified compound or one which is less than fully esterified, e.g., glyceryl tri-stearate, glyceryl di-laurate, glyceryl mono-oleate, etc. Esters of polyols, including diols and polyalkylene glycols may be used such as esters of mannitol, sorbitol, pentaerythritol, polyoxyethylene polyol, etc.

A mono- or di-hydroxy hydrocarbyl amine with a primary or secondary amine nitrogen may be reacted to form the fatty acid alkanols amides used in the fuel additive of the disclosed embodiments. Typically, the mono- or di-hydroxy hydrocarbyl amines may be characterized by the formula: $HN(R'OH)_{2-b}H_b$ wherein R' is as defined above and b is 0 or 1.

Typical amines may include, but are not limited to, ethanolamine, diethanolamine, propanolamine, isopropanolamine, dipropanotamine, diisopropanolamine, butanolamines etc.

Reaction may be effected by heating the oil containing the acid moiety and the amine in equivalent quantities to produce the desired product. Reaction may typically be effected by maintaining the reactants at about 100° C. to 200° C. for about 4 hours. Reaction may be carried out in a solvent that is compatible with the ultimate composition in which the product is to be used. Typical reaction products which may be used in the practice of the disclosed embodiments may include those formed from esters having the following acid moieties and alkanolamines:

TABLE 1

| Acid Moiety in Ester | Amine |
|---|---|
| Lauric Acid | propanolamine |
| Lauric Acid | diethanolamine |
| Lauric Acid | ethanolamine |
| Lauric Acid | dipropanolamine |
| Palmitic Acid | diethanolamine |
| Palmitic Acid | ethanolamine |
| Stearic Acid | diethanolamine |
| Stearic Acid | ethanolamine |

Other useful mixed reaction products with alkanolamines may be formed from the acid component of the following oils: coconut, babassu, palm kernel, palm, olive, castor, peanut, rape, beef tallow, lard, whale blubber, corn, tall, cottonseed, etc.

In one embodiment, the desired reaction product may be prepared by the reaction of (i) a fatty acid ester of a polyhydroxy compound (wherein some or all of the OH groups are esterified) and (ii) diethanolamine.

Typical fatty acid esters may include esters of the fatty acids containing from about 6 to 20, for example from about 8 to 16, and desirably about 12, carbon atoms. These acids may be characterized by the formula RCOOH wherein R is an alkyl hydrocarbon group containing from about 7 to 15, for example from about 11 to 13, and desirably about 11 carbon atoms.

Typical of the fatty acid esters which may be employed may be glyceryl tri-laurate, glyceryl tri-stearate, glyceryl tri-palmitate, glyceryl di-laurate, glyceryl mono-stearate, ethylene glycol di-laurate, pentaerythritol tetra-stearate, pentaerythritol tri-laurate, sorbitol mono-palmitate, sorbitol penta-stearate, propylene glycol mono-stearate.

The esters may include those wherein the acid moiety is a mixture as is typified by the following natural coconut, babassu, palm kernel, palm, olive, caster, peanut, rape, beef tallow, lard (leaf), lard oil, whale blubber.

Examples of desirable alkyl amides suitable for the disclosed embodiments include, but are not limited to, octyl amide (capryl amide), nonyl amide, decyl amide (caprin amide), undecyl amide dodecyl amide (lauryl amide), tridecyl amide, teradecyl amide (myristyl amide), pentadecyl amide, hexadecyl amide (palmityl amide), heptadecyl amide, octadecyl amide (stearyl amide), nonadecyl amide, eicosyl amide (alkyl amide), or docosyl amide (behenyl amide). Examples of desirable alkenyl amides include, but are not limited to, palmitootein amide, oleyl amide, isooleyl amide, elaidyl amide, linolyl amide, linoleyl amide. Preferably, the alkyl or alkenyl amide is a coconut oil fatty acid amide.

The preparation of hydrocarbyl amides from fatty acid esters and alkanolamines is described, for example, in U.S. Pat. No. 4,729,769 to Schlicht et al., the disclosure of which is incorporated herein by reference.

The hydrocarbyl amide which may be used in the fuel additive composition of the disclosed embodiments will typically have the following structure:

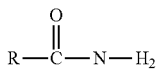

wherein R is a hydrocarbyl group having from about 6 to 30 carbon atoms.

The hydrocarbyl amide may be an alkyl amide having from about 7 to 31 carbon atoms or an alkenyl amide having one or two unsaturated groups and from about 7 to 31 carbon atoms. Examples of the alkyl amide include octane amide (capryl amide), nonane amide, decane amide (caprin amide), undecane amide, dodecane amide (lauryl amide), tridecane amide, tetradecane amide (myristyl amide), pentadecane amide, hexadecane amide (palmityl amide), heptadecane amide, octadecane amide (stearyl amide), nanodecane amide, eicosane amide (aralkyl amide), and docosane amide (behenyl amide). Preferred examples of the alkenyl amide include palmitolein amide, oleyl amide, isooleyl amide, elaidyl amide, linolyl amide, and linoleyl amide.

The hydrocarbyl amide used in the fuel additive composition of the disclosed embodiments is typically the reaction product of a $C_7$ to $C_{31}$ fatty acid or ester and ammonia.

Another antiwear additive that may be used is a hydrocarbyl imide. As used herein the term "imide" is meant to encompass the completed reaction product from reaction between ammonia and a hydrocarbyl-substituted succinic acid or anhydride (or like succinic acylating agent), and is intended to encompass compounds wherein the product may have amide, and/or salt linkages in addition to the imide linkage of the type that results from the reaction of or contact with ammonia, and an anhydride moiety.

The hydrocarbyl-substituted imides for use as antiwear additives in the fuels of the disclosure are well known. They are readily made by first reacting an olefinically unsaturated hydrocarbon of a desired molecular weight with maleic anhydride to form a hydrocarbyl-substituted succinic anhydride. Reaction temperatures of about 100° C. to about 250° C. may be used. With higher boiling olefinically-unsaturated hydrocarbons, good results are obtained at about 200° C. to about 250° C. The foregoing reaction may be promoted by the addition of chlorine. Alkenyl succinimides in which the succinic group contains a hydrocarbyl substituent containing at least 40 carbon atoms are described for example in U.S. Pat. Nos. 3,172,892; 3,202,678; 3,216,936; 3,219,666; 3,254,025; 3,272,746; 4,234,435; 4,613,341; and 5,575,823, the disclosures of all of which are hereby incorporated by reference.

Typical olefins include, but are not limited to, cracked wax olefins, linear alpha olefins, branched chain alpha olefins, polymers and copolymers of lower olefins. The olefins may be chosen from ethylene, propylene, butylene, such as isobutylene, 1-octane, 1-hexene, 1-decene and the like. Useful polymers and/or copolymers include, but are not limited to, polypropylene, polybutenes, polyisobutene, ethylene-propylene copolymers, ethylene-isobutylene copolymers, propylene-isobutylene copolymers, ethylene-1-decene copolymers and the like.

Hydrocarbyl substituents have also been made from olefin terpolymers. Very useful products can be made from ethylene-$C_{3-12}$ alpha olefin-$C_{5-12}$ non-conjugated diene terpolymers; such as ethylene-propylene-1,4-hexadiene terpolymer; ethylenepropylene-1,5-cyclooctadiene terpolymer; ethylene-propylenenorbornene terpolymers and the like.

In one embodiment, the hydrocarbyl substituents are derived from butene polymers, for example polymers of isobutylene. Suitable polyisobutenes for use in preparing the succinimide-acids of the present disclosure can in one embodiment include those polyisobutenes that comprise at least about 20% of the more reactive methylvinylidene isomer, for example at least 50%, and as a further example at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808, the disclosures of which are hereby incorporated by reference.

The molecular weight of the hydrocarbyl substituent may vary over a wide range. The hydrocarbyl group may have a molecular weight of less than 600 Daltons. An exemplary range is about 100 to about 300 number average molecular weight, for example from about 150 to about 275, as determined by gel permeation chromatography (GPC). Thus, hydrocarbyl groups of predominantly $C_4$-$C_{36}$ are useful herein with $C_{14}$-$C_{18}$ hydrocarbyl groups being particularly effective on the succinimide in providing improved antiwear properties to a gasoline fuel.

Carboxylic reactants other than maleic anhydride may be used such as maleic acid, fumaric acid, malic acid, tartaric acid, itaconic acid, itaconic anhydride, citraconic acid, citraconic anhydride, inesaconic acid, ethylmaleic anhydride, dimethylmaleic anhydride, ethylmaleic acid, dimethylmaleic acid, hexylmaleic acid, and the like, including the corresponding acid halides and lower aliphatic esters.

For example, hydrocarbyl-substituted succinic anhydrides may be prepared by the thermal reaction of a polyolefin and maleic anhydride, as described, for example in U.S. Pat. Nos. 3,361,673 and 3,676,089, the disclosures of which are incorporated by reference. Alternatively, the substituted succinic anhydrides may be prepared by the reaction of chlorinated polyolefins with maleic anhydride, as described, for example, in U.S. Pat. No. 3,172,892, the disclosure of which is incorporated by reference. A further discussion of hydrocarbyl-substituted succinic anhydrides may be found, for example, in U.S. Pat. Nos. 4,234,435; 5,620,486 and 5,393,309, the disclosures of which are incorporated by reference.

The mole ratio of maleic anhydride to olefin unsaturated hydrocarbon may vary widely. Accordingly, the mole ratio may vary from about 5:1 to about 1:5, for example from about 3:1 to about 1:3, and as a further example the maleic anhydride can be used in stoichiometric excess to force the reaction to completion. The unreacted maleic anhydride may be removed by vacuum distillation.

The reaction between the hydrocarbyl-substituted succinic anhydride and the ammonia can in one embodiment be carried out by mixing the components and heating the mixture to a temperature high enough to cause a reaction to occur but not so high as to cause decomposition of the reactants or products or the anhydride may be heated to reaction temperature and the ammonia added over an extended period. A useful temperature is about 100° C. to about 250° C. Exemplary results may be obtained by conducting the reaction at a temperature high enough to distill out water formed in the reaction.

The antiwear agent may be present in the fuel in a minor amount. Typically, the antiwear agent is present in an amount ranging from about 5 ppm to about 50 ppm, such as from about 20 to about 40 ppm.

Optional Additives

The fuel compositions of the present disclosure may contain supplemental additives in addition to the detergent(s) and carrier fluids described above. Said supplemental additives include additional dispersants/detergents, antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, lubricity additives and combustion improvers.

The additives used in formulating the fuel compositions according to the disclosure may be blended into the base fuel individually or in various sub-combinations. However, it is desirable to blend all of the components concurrently using an additive concentrate as this takes advantage of the mutual compatibility afforded by the combination of ingredients when in the form of an additive concentrate. Also use of a concentrate reduces blending time and lessens the possibility of blending errors.

Other aspects of the disclosed embodiments include fuels for spark-ignition engines into which have been blended small amounts of the various compositions of the invention described herein, as well as methods for reducing or minimizing intake valve and injector deposits by fueling and/or operating the engine with the fuel compositions of the disclosed embodiments.

Base Fuel

The base fuels used in formulating the fuel compositions of the disclosed embodiments include any base fuels suitable for use in the operation of spark-ignition internal combustion engines such as leaded or unleaded motor and aviation gasolines, and so-called reformulated gasolines which typically contain both hydrocarbons of the gasoline boiling range and fuel-soluble oxygenated blending agents ("oxygenates"), such as alcohols, ethers and other suitable oxygen-containing organic compounds. For example, the fuel may include a mixture of hydrocarbons boiling in the gasoline boiling range. Such fuel may consist of straight chain or branch chain paraffins, cycloparaffins, olefins, aromatic hydrocarbons or any mixture of thereof. The gasoline may be derived from straight run naptha, polymer gasoline, natural gasoline or from catalytically reformed stocks boiling in the range from about 27° to about 230° C. The octane level of the gasoline is not critical and any conventional gasoline may be used in embodiments of the disclosure.

The fuel may also contain oxygenates. Oxygenates suitable for use in the disclosed embodiments include methanol, ethanol, isopropanol, t-butanol, n-butanol, bio-butanol, mixed $C_1$ to $C_5$ alcohols, methyl tertiary butyl ether, tertiary amyl methylether, ethyl tertiary butyl ether and mixed ethers. Oxygenates, when used, will normally be present in the base fuel in an amount below about 85% by volume, and preferably in an amount that provides an oxygen content in the overall fuel in the range of about 0.5 to about 5 percent by volume.

In one embodiment, a mixture of hydrocarbons in the gasoline boiling range comprises a liquid hydrocarbon distillate fuel component, or mixture of such components, containing hydrocarbons which boil in the range from about 0° C. to about 250° C. (ASTM D86 or EN ISO 3405) or from about 20° C. or about 25° C. to about 200° C. or about 230° C. The optimal boiling ranges and distillation curves for such base fuels will typically vary according to the conditions of their intended use, for example the climate, the season and any applicable local regulatory standards or consumer preferences.

The hydrocarbon fuel component(s) may be obtained from any suitable source. They may for example be derived from petroleum, coal tar, natural gas or wood, in particular petroleum. Alternatively, they may be synthetic products such as from a Fischer-Tropsch synthesis. Conveniently, they may be derived in any known manner from straight-run gasoline, synthetically-produced aromatic hydrocarbon mixtures, thermally or catalytically cracked hydrocarbons, hydrocracked petroleum fractions, catalytically reformed hydrocarbons or mixtures of these.

In a preferred embodiment, the hydrocarbon fuel component(s) comprise components selected from one or more of the following groups: saturated hydrocarbons, olefinic hydrocarbons, aromatic hydrocarbons, and oxygenated hydrocarbons. In a particular embodiment, a mixture of hydrocarbons in the gasoline boiling range comprises a mixture of saturated hydrocarbons, olefinic hydrocarbons, aromatic hydrocarbons, and, optionally, oxygenated hydrocarbons. In a preferred embodiment, a mixture of hydrocarbons in the gasoline boiling range gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. In one embodiment, the base filet is derived from straight run gasoline, polymer gasoline, natural gasoline, dimer and trimerized olefins, synthetically produced aromatic hydrocarbon mixtures, or from catalytically cracked or thermally cracked petroleum stocks, and mixtures of these. The hydrocarbon composition and octane level of the base fuel are not critical. In a specific embodiment, the octane level, (RON+MON)/2, will generally be above about 80. Any conventional motor fuel base may be used in embodiments of the present invention. For example, in certain embodiments, hydrocarbons in the gasoline may be replaced by up to a substantial amount of conventional alcohols or ethers, conventionally known for use in fuels. In one embodiment, the base fuels are desirably substantially free of water since water may impede smooth combustion.

The gasoline base fuel, or a mixture of hydrocarbons in the gasoline boiling range, represents a proportion of the fuel composition of embodiments of the invention. The term "major amount" is used herein because the amount of hydrocarbons in the gasoline range is often about 50 weight or volume percent or more. The gasoline base fuel may be present in the gasoline composition from about 15% v/v or higher, more preferably about 50% v/v or greater. In one embodiment, the concentration may be up to about 15% v/v, or up to about 49% v/v. In another embodiment, the concentration may be up to about 60% v/v, up to about 6.5% v/v, up to about 70% v/v, up to about 80% v/v, or even up to about 90% v/v.

The United States gasoline specification for the hydrocarbon base fluid (a) in the gasoline composition which is preferred has the following physical properties and can be seen in Table 2.

TABLE 2

US Gasoline Physical Properties

| Properties | Units | Min | Max |
|---|---|---|---|
| Vapor Pressure | psi vol % | 6.4 | 15.0 |
| Distillation (° F./Evap) | 10% | 122 | 158 |
| | 50% | 150 | 250 |
| | 90% | 210 | 365 |
| | EP | 230 | 437 |
| Drivability Index* | | 1050 | 1250 |

*DI = 1.5 (T10) + 3.0 (T50) + 2.4 (ETOH vol %)

The gasoline specification D 4814 controls the volatility of gasoline by setting limits for the vapor pressure, distillation, drivability index and the fuels end point. The oxygenate amount in the fuel is less than 20 vol % is determined under ASTM D4815; however if the oxygenate amount is greater than 20 vol %, the method should be ASTM D5501.

The European Union gasoline specification for the hydrocarbon base fuel in the gasoline composition in which is preferred has the following physical properties which are shown in Table 3.

TABLE 3

European Gasoline Specification

| Properties | Units | Min | Max |
|---|---|---|---|
| Vapor Pressure | Kpa | 45.0 | 90.0 |
| % Evap at | Vol % | | |
| 70° C. | | 20 | 50 |
| 100° C. | | 46 | 71 |
| 150° C. | | 75 | |
| FP | | | 210 |
| Distillation Residue | | | 2 |
| VLI (10 $VP_{psi}$ + 7 E70) | | 1050 | 1250 |

Hydrocarbons in the gasoline can be replaced by up to a substantial amount of conventional alcohols or ethers, conventionally known for use in fuels. The base fluids are desirably substantially free of water since water could impede a smooth combustion.

The hydrocarbon fuel mixture of an embodiment is substantially lea but may contain minor amounts of blending agents such as methanol, ethanol, ethyl tertiary butyl ether, methyl tertiary butyl ether, tert-amyl methyl ether and the like, at from about 0.1% by volume to about 85% by volume of the base fuel, although larger amounts may be utilized.

Another embodiment of the disclosure provides a method for improving at least one of reducing intake valve deposits or improving antiwear performance in a spark-ignition engine, or both. The method includes providing a fuel composition that includes: (a) a major amount of a gasoline fuel containing ethanol, (b) a minor amount of a first Mannich base detergent derived from a di- or polyamine, (c) minor amount of a second Mannich base detergent derived from an di-alkyl monoamine, (d) an antiwear component selected from the group consisting of a hydrocarbyl amide and a hydrocarbyl imide, and (e) a polyether carrier fluid comprising C6-C20 alkylphenol propoxylate. A weight ratio of the first Mannich base detergent to the second Mannich base detergent in the fuel composition ranges from 1:1 to about 10:1. The fuel composition is supplied to the engine and combusted in the engine.

Another embodiment of the disclosure provides a method for improving both intake valve deposits and improving antiwear performance in a spark-ignition engine. The method includes providing a fuel composition that includes: (a) a major amount of a gasoline fuel containing ethanol, (b) a minor amount of a first Mannich base detergent derived from a di- or polyamine, (c) minor amount of a second Mannich base detergent derived from an di-alkyl monoamine, (d) an antiwear component selected from the group consisting of a hydrocarbyl amide and a hydrocarbyl imide, and (e) a polyether carrier fluid comprising $C_6$-$C_{70}$ alkylphenol propoxylate. A weight ratio of the first Mannich base detergent to the second Mannich base detergent in the fuel composition ranges from 1:1 to about 10:1. The fuel composition is supplied to the engine and combusted in the engine. In one embodiment the gasoline fuel can contain up to 85% by volume ethanol or blended oxygenates.

A further embodiment of the disclosure provides a method for operating a spark-ignition engine on an unleaded fuel composition. The method includes supplying to the engine a fuel composition containing: (a) a gasoline fuel, (b) a first Mannich base detergent derived from a di- or polyamine, (c) a second Mannich base detergent derived from a dialkyl monoamine, (d) an antiwear component selected from the group consisting of a hydrocarbyl amide and a hydrocarbyl imide, and (e) optionally, a succinimide detergent. The first and second Mannich base detergents are present in the fuel composition in a weight ratio of from about 1:1 to about 10:1. The fuel composition is introduced into the engine and the engine is operated on and combusts the fuel composition. In another embodiment the succinimide detergent is required.

EXAMPLES

The practice and advantages of the disclosed embodiments may be demonstrated by the following examples, which are presented for purposes of illustration and not limitation. Unless indicated otherwise, all amounts, percentages and ratios are by weight.

Example 1

A series of engine tests were performed to assess the effectiveness of the mixed Mannich detergents on deposit inhibition.

The first Mannich base detergent used in the tests was obtained as a reaction product derived from the reaction of a long chain polyisobutylene-substituted cresol ("PBC"), N,N-dimethyl-1,3-propanediamine ("DMPD"), and formaldehyde ("FA"). The second Mannich base detergent used in the tests was obtained as a reaction product derived from the reaction of a long chain polyisobutylene-substituted cresol, di-butylamine, and formaldehyde.

To demonstrate the effectiveness of the mixed Mannich base detergent additive systems in an unleaded fuel composition containing 10 vol. % ethanol, a 2.3 L Ford engine was used for the tests. Carrier Fluid 1 was a nonylphenol propoxylate made with 24 moles of propylene oxide. Carrier Fluid 2 was a stearyl alcohol propoxylate made with 30 moles of propylene oxide. Antiwear 1 was a succinimide made from a $C_{16}$ alkyl substituted succinic anhydride and ammonia. Antiwear 2 was an alkanol amide made from diethanol amine and oleic acid. The succinimide detergent was a polyisobutenyl succinimide made from tetraethylenepentamine.

Amounts and ratios of the components that can be used according to comparative examples and embodiments of the disclosure are shown in the following Table 4. The results are shown in the following Tables 5-9, In the tables, PTB means pounds per thousand barrels. The conversion factor for converting from ppm to PTB by weight is 3.86 ppm per PTB with a fuel density of 0.74.

In Table 5, the treat rate was 95 PTB and the solids content was 48.6 PTB. In Table 6, the treat rate was 90 PTB and the solids content was 49.10 for the comparative examples and 49.6 for Example 6. In Table 7, Examples 7-8 had a treat rate of 90 PTB and a solids content of 49.60 PTB; Examples 9-10 had a treat rate of 70 PTB and a solids content of 38.60 PTB; and Comparative Examples 5-6 had a treat rate of 100 PTB and a solids content of 41.00 PTB. In Table 8, Comparative Example 7 and Examples 11-14 had a treat rate of 90 PTB, Comparative Example 8 had a solids content of 49.10 PTB; Examples 11-13 had a solids content of 49.6 PTB; and Example 14 had a solids content of 52.10 PTB In Table 9, Comparative Examples 8-11 had a treat rate of 100 PTB; Comparative Examples 12-13 had a treat rate of 85 PTB; Comparative Examples 8-9 had a solids content of 38.5 PTB; Comparative Examples 10-11 had a solids content of 48.5 PTB; and Comparative Examples 12-13 had a solids content of 37.7 PTB.

TABLE 4

Solid Content of test fuels in PTB

| 1st Mannich Base Det. (M1) (PTB) | 2nd Mannich Base Det. (M2) (PTB) | Carrier Fluid 1 (PTB) | Succinimide Detergent (PTB) | Antiwear 1 (PTB) | TOTAL | M1/M2 Wt. Ratio | Carrier Fluid 1/(M1 + M2) Ratio |
|---|---|---|---|---|---|---|---|
| 32.83 | 0.00 | 22.11 | 2.5 | 0.00 | 60.67 | — | 0.67 |
| 0.00 | 32.83 | 22.11 | 2.5 | 0.00 | 60.67 | — | 0.67 |
| 16.42 | 16.42 | 22.11 | 2.5 | 0.00 | 60.67 | 1.00 | 0.67 |
| 8.21 | 24.62 | 22.11 | 2.5 | 0.00 | 60.67 | 0.33 | 0.67 |
| 24.62 | 8.21 | 22.11 | 2.5 | 0.00 | 60.67 | 3.00 | 0.67 |
| 4.69 | 28.14 | 22.11 | 2.5 | 0.00 | 60.67 | 0.17 | 0.67 |
| 28.14 | 4.69 | 22.11 | 2.5 | 0.00 | 60.67 | 6.00 | 0.67 |
| 28.14 | 4.69 | 22.11 | 2.5 | 4.00 | 60.67 | 6.00 | 0.67 |
| 28.14 | 4.69 | 22.11 | 2.5 | 8.00 | 60.67 | 6.00 | 0.67 |
| 28.14 | 4.69 | 30.00 | 2.5 | 0.00 | 68.57 | 6.00 | 0.91 |
| 28.14 | 4.69 | 14.11 | 2.5 | 0.00 | 52.67 | 6.00 | 0.43 |
| 28.14 | 4.69 | 14.11 | 2.5 | 4.00 | 56.67 | 6.00 | 0.43 |
| 28.14 | 4.69 | 30.00 | 2.5 | 4.00 | 72.57 | 6.00 | 0.91 |

TABLE 5

| Run No. | 1st Mannich Base Det. (PTB) | 2nd Mannich Base Det. (PTB) | Carrier Fluid 1 (PTB) | Carrier Fluid 2 (PTB) | Antiwear 1 (PTB) | Succinimide Detergent (PTB) | Wt. Ratio 1st Mannich to 2nd Mannich | Avg IVD (mg) |
|---|---|---|---|---|---|---|---|---|
| Comp. 1 | 25.00 | — | 21.0 | — | — | 2.60 | 1:0 | 55.2 |
| Comp. 2 | — | 25.00 | 21.0 | — | — | 2.60 | 0:1 | 58.1 |
| Ex. 1 | 12.50 | 12.50 | 21.0 | — | — | 2.60 | 1:1 | 38.6 |
| Ex. 2 | 6.25 | 18.75 | 21.0 | — | — | 2.60 | 1:3 | 37.1 |
| Ex. 3 | 18.75 | 6.25 | 21.0 | — | — | 2.60 | 3:1 | 40.3 |
| Ex. 4 | 3.60 | 21.40 | 21.0 | — | — | 2.60 | 1:6 | 46.6 |
| Ex. 5 | 21.40 | 3.60 | 21.0 | — | — | 2.60 | 6:1 | 59.0 |

TABLE 6

| Run No. | 1st Mannich Base Det. (PTB) | 2nd Mannich Base Det. (PTB) | Carrier Fluid 1 (PTB) | Carrier Fluid 2 (PTB) | Antiwear 1 (PTB) | Succinimide Detergent (PTB) | Wt. Ratio 1st Mannich to 2nd Mannich | Avg IVD (mg) |
|---|---|---|---|---|---|---|---|---|
| Comp. 3 | 25.90 | — | 20.7 | — | — | 2.50 | 1:0 | 67.0 |
| Comp. 4 | 25.90 | — | 20.7 | — | — | 2.50 | 1:0 | 70.3 |
| Ex. 6 | 18.00 | 6.00 | 23.1 | — | — | 2.50 | 3:1 | 49.5 |

TABLE 7

| Run No. | 1st Mannich Base Det. (PTB) | 2nd Mannich Base Det. (PTB) | Carrier Fluid 1 (PTB) | Carrier Fluid 2 (PTB) | Antiwear 1 (PTB) | Succinimide Detergent (PTB) | Wt. Ratio 1st Mannich to 2nd Mannich | Avg IVD (mg) |
|---|---|---|---|---|---|---|---|---|
| Ex. 7 | 22.40 | 3.70 | 21.00 | — | — | 2.50 | 6:1 | 61.1 |
| Ex. 8 | 22.40 | 3.70 | — | 21.00 | — | 2.50 | 6:1 | 43.0 |
| Ex. 9 | 10.65 | 10.65 | 15.40 | — | — | 1.90 | 1:1 | 144.2 |
| Ex. 10 | 10.65 | 10.65 | — | 15.40 | — | 1.90 | 1:1 | 90.2 |
| Comp. 5 | 26.00 | — | 12.50 | — | 8.00 | 2.50 | 1:0 | 65.1 |
| Comp. 6 | 26.00 | — | — | 12.50 | 8.00 | 2.50 | 1:0 | 29.3 |

TABLE 8

| Run No. | 1st Mannich Base Det. (PTB) | 2nd Mannich Base Det. (PTB) | Carrier Fluid 1 (PTB) | Carrier Fluid 2 (PTB) | Antiwear 1 (PTB) | Succinimide Detergent (PTB) | Wt. Ratio 1st Mannich to 2nd Mannich | Avg IVD (mg) |
|---|---|---|---|---|---|---|---|---|
| Comp. 7 | 25.90 | — | 20.70 | — | — | 2.50 | 1:0 | 72.4 |
| Ex. 11 | 22.40 | 3.70 | 21.00 | — | — | 2.50 | 6:1 | 57.5 |
| Ex. 12 | 22.40 | 3.70 | 21.00 | — | 8.00 | 2.50 | 6:1 | 35.2 |
| Ex. 13 | 22.40 | 3.70 | 21.00 | | 8.00 | 2.50 | 6:1 | 48.8 |
| Ex. 14 | 22.40 | 3.70 | 23.50 | | 8.00 | 2.50 | 6:1 | 50.9 |

TABLE 9

| Run No. | 1st Mannich Base Det. (PTB) | 2nd Mannich Base Det. (PTB) | Carrier Fluid 1 (PTB) | Carrier Fluid 2 (PTB) | Antiwear 1 (PTB) | Succinimide Detergent (PTB) | Wt. Ratio 1st Mannich to 2nd Mannich | Avg IVD (mg) |
|---|---|---|---|---|---|---|---|---|
| Comp. 8 | 26.00 | — | 10.00 | — | 2.00 | 2.50 | 1:0 | 73.5 |
| Comp. 9 | 26.00 | — | 10.00 | — | 10.00 | 2.50 | 1:0 | 84.8 |
| Comp. 10 | 26.00 | — | 20.00 | — | 2.00 | 2.50 | 1:0 | 69.6 |
| Comp. 11 | 26.00 | — | 20.00 | — | 14.00 | 2.50 | 1:0 | 84.6 |
| Comp. 12 | 22.80 | — | 12.60 | — | 0.00 | 2.30 | 1:0 | 60.6 |
| Comp. 13 | 22.80 | — | 12.60 | — | 8.00 | 2.30 | 1:0 | 88.6 |

Tables 5 and 6 show that a combination of the first Mannich base detergent with the second Mannich base detergent in a weight ratio of 1:6 to 3:1 (Examples 1-4) provides a synergistic decrease in intake valve deposits (IVD) compared to the IVD for either one of the Mannich base detergents alone (Comparative Examples 1-4).

Table 7 shows that, in all cases, Carrier Fluid 2 has a positive impact on the IVD, whether or not a combination of Mannich base detergents are used and that the overall treat rate of the additive has an impact on the IVD, i.e., the lower the overall treat rate, the higher the IVD.

Table 8 shows the positive effect an antiwear agent in combination with the Mannich base detergent has on the IVD when the ratio of first Mannich base detergent to second Mannich base detergent is above 3:1.

Table 9 shows that using an antiwear agent at a treat rate of 2 to 14 PTB has a negative impact on IVD when only one the first Mannich base detergent is present in the additive.

Example 2

The following example demonstrates improved antiwear properties of the mixed Mannich base detergent additive systems in a fully formulated unleaded fuel composition containing 0 to 20 vol. % ethanol. In all of the runs, the antiwear agent was Antiwear 1 described above. The Mannich base detergent mixture had a weight ratio of M1/M2 of 6:1 as shown in Table 4 above. The Carrier Fluid 1 was present in an amount of 21 PTB and the succinimide dispersant was present in an amount of 2.5 PTB. The wear scar was measured according to ASTM D 6079 (Gasoline Method).

TABLE 10

| Vol. % Ethanol in Fuel | Antiwear 1 (PTB) | M1 + M2 Mannich detergent mixture (PTB) | Wear scar (mm) |
|---|---|---|---|
| 0 | 0 | 0 | 700 |
| 0 | 8 | 26.1 | 580 |
| 0 | 16 | 52.2 | 525 |
| 10 | 0 | 0 | 750 |
| 10 | 0 | 52.2 | 775 |
| 10 | 0 | 52.2 | 785 |
| 10 | 8 | 26.1 | 702 |
| 10 | 16 | 52.2 | 640 |

TABLE 10-continued

| Vol. % Ethanol in Fuel | Antiwear 1 (PTB) | M1 + M2 Mannich detergent mixture (PTB) | Wear scar (mm) |
|---|---|---|---|
| 20 | 0 | 0 | 770 |
| 20 | 8 | 26.1 | 715 |
| 20 | 16 | 52.2 | 660 |

Table 10 presents wear scar test data generated using ASTM D 6079 (Gasoline Modified, 75 minutes and 25 degrees C.). The table illustrates the adverse effect observed in the market place on wear scar performance of increasing the ethanol content of a gasoline. The zero %, 10% and 20% ethanol content with no additive in the gasoline provided wear scar values of 700, 750 and 770, respectively. A problem that therefore needed to be addressed was enabling the increased use of oxygenate in gasoline without increasing engine wear, and in fact, reducing engine wear. Thus, according to the present disclosure, the introduction of the antiwear additive in all levels of ethanol content improved (reduced) the wear scar values. As shown by the foregoing results, the wear scar is significantly improved from 700 to 580 mm using 26.1 PTB of the mixed Mannich base detergent system and Antiwear 1 in a fully formulated gasoline composition containing no ethanol. Doubling Antiwear 1 and the amount of mixed Mannich detergent reduced the wear scar further to 525 mm. The same trend was shown for a gasoline fuel containing 10 volume percent ethanol. However, the base fuel without additive at 10 vol. % ethanol had a much higher wear scar 750 mm versus 700 mm for the gasoline fuel devoid of ethanol. At 20 vol. % ethanol, the wear sear of the base gasoline without additive was 770 mm. The Antiwear 1 and mixed Mannich base detergents provided a significant improvement in wear scar at a treat rate of the mixed Mannich base detergents of 26.1 PTB and 8 PTB of Antiwear 1 in gasoline containing 20 vol. % ethanol. Accordingly, while increasing the ethanol content of the gasoline from 0 to 20% by volume tends to increase the wear scar, the mixed Mannich base detergent system and Antiwear 1 were effective in significantly reducing the wear sear increase caused by the ethanol. As seen in Tables 5-8, the inclusion of the same mixed Mannich detergent additive package of the present disclosure also improved IVD performance.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as a Mannich condensation reaction) or in forming a desired composition (such as an additive concentrate or additized fuel blend). It will also be recognized that the additive components can be added or blended into or with the base fuels individually per se and/or as components used in forming preformed additive combinations and/or subcombinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations is thus wholly immaterial for an accurate understanding and appreciation of this disclosure and the claims thereof.

As used herein the term "fuel-soluble" or "gasoline-soluble" means that the substance under discussion should be sufficiently soluble at 20° C. in the base fuel selected for use to reach at least the minimum concentration required to enable the substance to serve its intended function. Preferably, the substance will have a substantially greater solubility in the base fuel than this. However, the substance need not dissolve in the base fuel in all proportions.

At numerous places throughout this specification, reference has been made to a number of U.S. Patents and published foreign patent applications. All such cited documents are expressly incorporated in full into this disclosure as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A detergent additive package for an unleaded gasoline fuel comprising a Mannich base detergent mixture, wherein the mixture comprises a first Mannich base detergent component having a tertiary amino group and derived from an aliphatic linear, branched, or cyclic diamine having one primary or secondary amine group and one tertiary amino group in the molecule and a second Mannich base detergent component derived from a monoamine, wherein a weight ratio of the first Mannich base detergent to the second Mannich base detergent in the mixture ranges from about 1:6 to about 3:1.

2. The detergent package of claim 1, further comprising a carrier fluid, wherein a weight ratio of carrier fluid to Mannich base detergent mixture ranges from about 0.25:1 to about 1:1.

3. The detergent package of claim 1, wherein the weight ratio of the first Mannich base detergent to the second Mannich base detergent ranges from about 1:1 to about 1:3.

4. The detergent package of claim 1, further comprising a succinimide detergent, wherein a weight ratio of succinimide detergent to Mannich base detergent mixture ranges from about 0.04:1 to about 0.2:1.

5. An additive concentrate comprising the detergent additive package of claim 1 and further comprising an antiwear component, selected from the group consisting of a hydrocarbyl amide and a hydrocarbyl imide.

6. An unleaded gasoline fuel composition comprising from about 40 to about 2000 ppm by weight of the additive concentrate of claim 5.

7. An unleaded gasoline fuel composition comprising from about 200 to about 400 ppm by weight of the additive concentrate of claim 5.

8. A fuel additive package for a spark-ignition engine comprising (a) a first Mannich base detergent component having a tertiary amino group and derived from an aliphatic linear, branched, or cyclic diamine having one primary or secondary amine group and one tertiary amino group in the molecule, (b) a second Mannich base detergent component derived from a monoamine, (c) an antiwear component, and (d) a carrier fluid component selected from the group consisting of a polyether monool and polyether polyol, wherein a weight ratio of the first Mannich base detergent to the second Mannich base detergent in the fuel additive package ranges from about 1:6 to about 3:1.

9. The fuel additive package of claim 8, wherein the antiwear component is selected from the group consisting of a hydrocarbyl amide and a hydrocarbyl imide.

10. An unleaded gasoline fuel composition comprising from about 40 to about 2000 ppm by weight of the fuel additive package of claim 8.

11. A method for operating a spark-ignition engine on an unleaded fuel composition, the method comprising:

supplying to the engine a fuel composition comprising:

(a) a gasoline fuel, (b) a first Mannich base detergent having a tertiary amino group and derived from an aliphatic linear, branched, or cyclic diamine having one primary or secondary amine group and one tertiary amino group in the molecule, (c) a second Mannich base detergent derived from a monoamine, (d) an antiwear component, and (e) optionally, a succinimide detergent, wherein a weight ratio of (b) to (c) in the fuel ranges from about 1:6 to about 3:1; introducing into the engine the fuel composition for combustion thereof, and operating the engine.

12. The method of claim 11, wherein the antiwear component is selected from the group consisting of a hydrocarbyl amide and a hydrocarbyl imide.

13. The method of claim 11, wherein detergents (b) and (c) are derived from polyisobutenyl phenol wherein the polyisobutenyl group has a molecular weight ranging from about 500 to about 1000 Daltons, as determined by gel permeation chromatography.

14. An unleaded fuel composition for a spark-ignited engine, comprising (a) a major amount of a gasoline fuel, (b) a minor amount of a first Mannich base detergent having a tertiary amino group and derived from an aliphatic linear, branched, or cyclic diamine having one primary or secondary amine group and one tertiary amino group in the molecule, (c) minor amount of a second Mannich base detergent derived from an di-alkyl monoamine, (d) an antiwear component selected from the group consisting of a hydrocarbyl amide and a hydrocarbyl imide, and (f) a polyether carrier fluid, wherein a weight ratio of the first Mannich base detergent to the second Mannich base detergent in the fuel composition ranges from 1:6 to about 3:1.

15. The unleaded fuel composition of claim 14, further comprising a succinimide detergent.

16. The unleaded fuel composition of claim 15, wherein a weight ratio of succinimide detergent to a total amount of the first and second Mannich base detergents ranges from about 0.04:1 to about 0.2:1.

17. The unleaded fuel composition of claim 15, wherein detergents (b) and (c) are derived from polyisobutenyl phenol wherein the polyisobutenyl group has a molecular weight ranging from about 500 to about 1000 Daltons, as determined by gel permeation chromatography.

18. A method for improving at least one of reducing intake valve deposits or improving antiwear performance in a spark-ignition engine, comprising a fuel composition comprising:

(a) a major amount of a gasoline fuel containing ethanol, (b) a minor amount of a first Mannich base detergent having a tertiary amino group and derived from an aliphatic linear, branched, or cyclic diamine having one primary or secondary amine group and one tertiary amino group in the molecule, (c) minor amount of a second Mannich base detergent derived from an di-alkyl monoamine, (d) an antiwear component selected from the group consisting of a hydrocarbyl amide and a hydrocarbyl imide, and (e) a polyether carrier fluid comprising $C_6$-$C_{20}$ alkylphenol propoxylate, wherein a weight ratio of the first Mannich base detergent to the second Mannich base detergent in the fuel composition ranges from 1:6 to about 3:1;

supplying the fuel composition to the engine, and combusting the fuel composition in the engine.

19. The method of claim 18, wherein the fuel composition further comprises a succinimide detergent.

20. The method of claim 18, wherein a weight ratio of the first Mannich base detergent to the second Mannich base detergent in the fuel composition ranges from 1:4 to about 2:1.

21. The method of claim 18, wherein a weight ratio of the first Mannich base detergent to the second Mannich base detergent in the fuel composition ranges from greater than 1:3 to about 1:1.

22. The detergent additive package of claim 1, wherein an unleaded gasoline fuel includes about 6 to about 22 PTB of the first Mannich base detergent component and 6 to 22 PTB of the second Mannich base detergent component.

* * * * *